United States Patent [19]

Marin

[11] Patent Number: 5,013,088

[45] Date of Patent: May 7, 1991

[54] DISINTEGRATABLE MASKING LABEL

[75] Inventor: Thomas C. Marin, Willow Grove, Pa.

[73] Assignee: Data Tech Servies, Inc., West Point, Pa.

[21] Appl. No.: 455,097

[22] Filed: Dec. 22, 1989

[51] Int. Cl.[5] ..... B42D 15/00

[52] U.S. Cl. ..... 283/81; 283/101; 283/105; 283/108; 283/110; 283/111; 283/901

[58] Field of Search ..... 283/81, 105, 108, 110, 283/101, 74, 75, 95, 98, 103, 111, 901, 900; 428/78

[56] References Cited

U.S. PATENT DOCUMENTS

| | | | |
|---|---|---|---|
| 2,346,219 | 10/1941 | Johnson | 283/105 X |
| 3,864,855 | 2/1975 | Pekko et al. | 283/81 |
| 3,983,645 | 10/1976 | Rycroft | 40/2.2 |
| 3,993,814 | 11/1976 | Cavendar | 283/101 X |
| 4,061,808 | 12/1977 | Sato | 283/101 X |
| 4,184,701 | 1/1980 | Franklin et al. | 283/94 |
| 4,210,688 | 7/1980 | Sato | 283/101 X |
| 4,246,307 | 1/1981 | Trautwein | 428/43 |
| 4,320,158 | 3/1982 | Seeley | 283/105 |
| 4,608,288 | 8/1986 | Spindler | 283/81 |

OTHER PUBLICATIONS

Letraset Instant Lettering Stencil (1980).

*Primary Examiner*—Frank T. Yost
*Assistant Examiner*—Thomas Hamill, Jr.
*Attorney, Agent, or Firm*—Scott J. Fields

[57] ABSTRACT

A disintegrating tamper-proof masking label comprising an opaque paper label having an adhesive backing for adhering said opaque label to a medium to be masked, a silicon coated polystyrene backing paper for holding said label, said label being peeled from said polystyrene backing so as to be applied to a medium to be masked, said label having a plurality of cuts such that when said label is removed from said medium, said label fragments thereby evidencing of said label.

9 Claims, 3 Drawing Sheets

FIG. 5
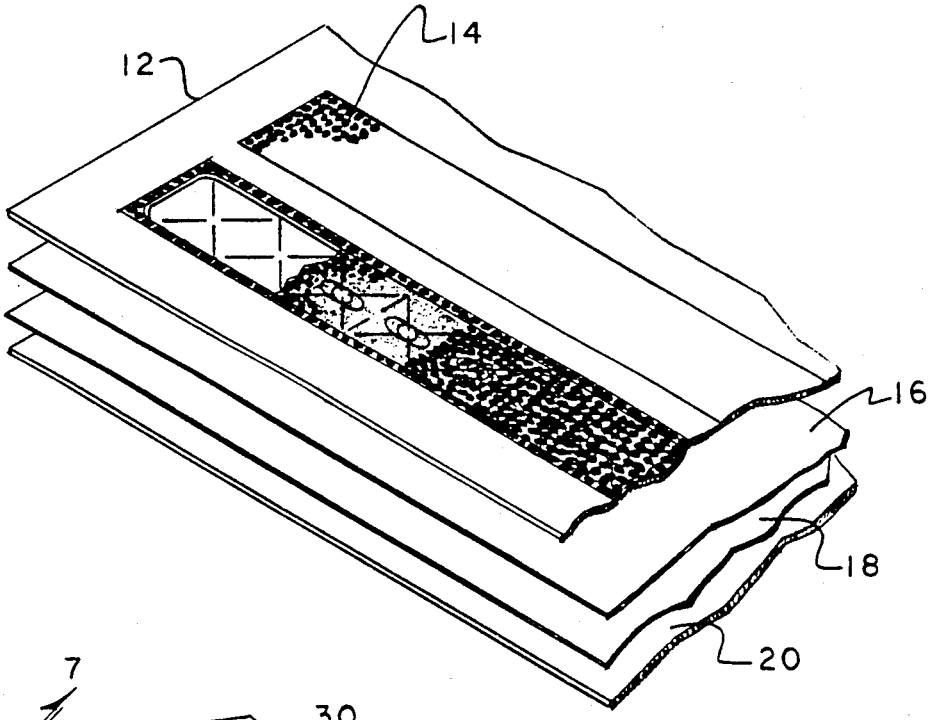
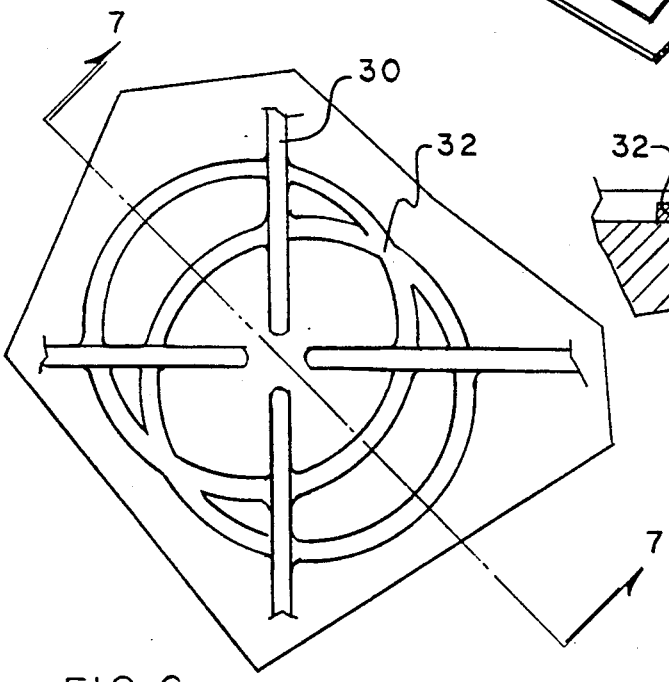
FIG.6
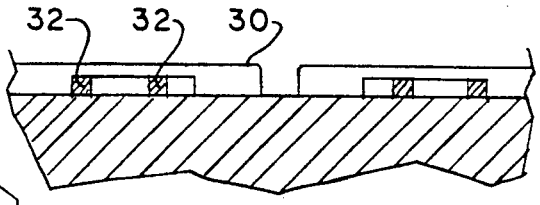
FIG.7

DISINTEGRATABLE MASKING LABEL

FIELD OF THE INVENTION

The present invention is directed to disintegratable masking or blocking labels. In particular, the present invention is directed to labels which can be placed over confidential research data, medical records, academic records and the like, and which fragment and disintegrate upon tampering so as to provide evidence of tampering.

BACKGROUND OF THE INVENTION

The present invention is directed to a novel disintegratable masking label which can be placed over confidential written material, and which fragments and disintegrates upon removal so as to provide evidence of tampering.

In today's research, business, academic and bio-medical environments, the integrity and absolute confidentiality of test results has achieved paramount importance. This is particularly true, for example, with respect to the written results of employee medical records on such matters as drug analysis. Numerous private and governmental entities have begun routinely conducting urinalysis testing for drug and alcohol dependency. It is important, both for the integrity of the test, and the confidentiality and privacy of the testee, that such results not be altered.

Previous efforts at providing tamper-proofing have been largely directed towards preventing the tampering of the packaging for pharmaceuticals and food products. This became a particularly serious problem in the early 1980's when the products of several leading drug manufacturers were altered, leading to the deaths of several individuals. There are a large number of patents which are directed toward detecting and preventing the tampering of pharmaceuticals and foodstuffs.

There have also been efforts at protecting the integrity and confidentiality of written matter. Previous products in this area have utilized multiple layered adhesive labels which were placed over confidential written material. The first layer would contact the written material with the second or top layer adhering to the first. When an attempt is made to remove the top layer, it pulls off parts of the underlying second layer thereby providing evidence of tampering. Labels produced in this manner are relatively expensive and do not always tear properly. Labels of this type also frequently destroy the underlying written material upon removal.

Finally, removable paints have been developed for masking written materials. These paints can be both messy and difficult to apply.

The present invention is directed to a novel label structure which is placed over written matter on a page and which is configured to fragment and disintegrate upon removal. This product, therefore, is useful in identifying whether confidential written results have been tampered with or altered.

The present invention utilizes a single layer structure including sets of tamper proof slits or cuts. The label is applied directly to an underlying paper surface containing confidential written material and is firmly embossed thereon. When the label is removed, it breaks apart at the slits or cuts, thus providing clear evidence of tampering. Because of the minuteness of the fragmentation, it is impossible to reconstruct the label so as to eliminate the evidence of tampering. The label is adhered with a removable adhesive and therefore does not destroy the underlying written matter upon removal.

In view of the above, it is an object of the present invention to provide a single layer disintegratable masking label which thereby evidences tampering.

It is an additional object of the present invention to provide an inexpensive masking label which can be utilized to determine whether research has been tampered with or violated.

It is still a further object of the present invention to provide a masking label which disintegrates upon removal from a masked medium.

It is still yet a further object of the present invention to provide a masking label containing tamper-proof cuts which cause the label to disintegrate upon removal from a masked medium.

SUMMARY OF THE INVENTION

In accordance with the present invention, a disintegrating tamper-proof masking label is disclosed. The label comprises an opaque paper label having a removable adhesive backing for adhering said opaque paper label to a medium to be masked, a silicone coated polystyrene lining paper for holding said label, said label being peeled from said polystyrene liner so as to be applied to a medium to be masked, said label having a plurality of cuts such that when said label is removed from said medium, said label fragments thereby evidencing the tampering of said label.

BRIEF DESCRIPTION OF DRAWINGS

The foregoing Summary as well as the following Detailed Description will be better understood when read in conjunction with the Figures appended hereto. For the purpose of illustrating the invention, there is shown in the drawings an embodiment which is presently preferred, it being understood, however, that this invention is not limited to the precise arrangements and instrumentalities shown.

FIG. 5 is an exploded view of the disintegratable masking label of the present invention.

FIG. 6 is a plan view of the die for manufacturing the label of the present invention.

FIG. 7 is a section view of the die for manufacturing the label of the present invention along line 7—7 of FIG. 6.

DETAILED DESCRIPTION OF THE PREFERRED EMBODIMENT

Figure 1:
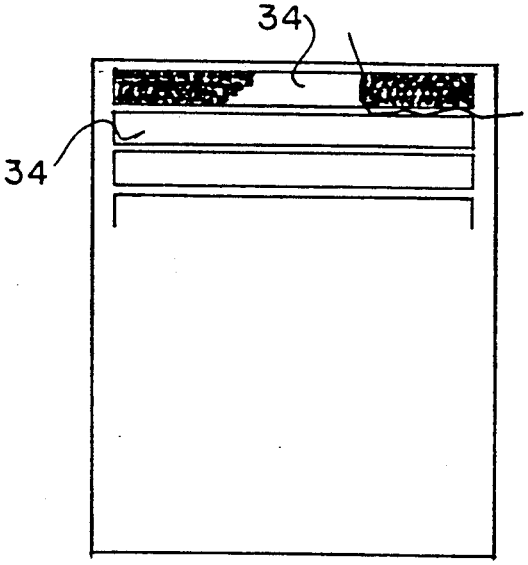
FIGS. 1 and 1A are partially broken away plan views of the disintegratable masking label of the present invention with a silicone coated polystyrene liner paper.
Figure 1A:
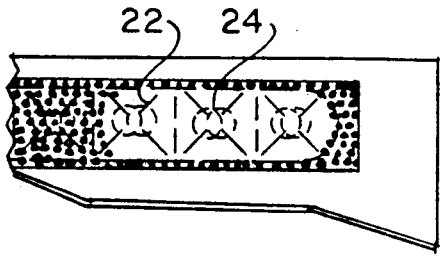

The present invention is described with reference to FIGS. 1–7 when the same numbers are used where applicable. Referring to FIGS. 1, 1A, 2, 2A and 5 the disintegratable masking label 10 of the present invention as shown. The label 10 is constructed from a paper 12 and preferably comprises a matted litho-label stock which possesses excellent print characteristics. As shown, the label has a dot pattern 14 printed thereon. It is noted that any pattern may be printed on the litho-stock of the present invention. As shown more particularly in the exploded view of FIG. 5, the underside of the paper 12 is coated with an opaque coating 16. Beneath the opaque coating 16, the label 10 is coated with a rubber based removable adhesive 18 featuring a moderately high tack and internal strength. An example of an adhesive 18 which may be utilized in the present invention is sold under the specification R-130 by Fasson, Incorporated of Grand Rapids, Mich. The label with adhesive is then secured onto a polystyrene liner 20 which is coated with silicone.

Referring to FIGS. 1, 1A, 2 and 2A, the label contains cuts or slits 22. The cuts or slits 22 form a plurality of X-shaped diagonal slits which are stamped completely through paper 12 and which cut through the polystyrene liner 20. The cuts extend radially from the center of the label 10. Additional cuts forming overlapping or interlocking rings 24 are simultaneously made on the center of the label. The rings 24 may be whole or perforated. These cuts do not permeate the silicone coated polystyrene lining 20. Finally, vertical perforated cuts 26 are interspersed throughout the label stock and may frame each set of diagonal radial cuts 20 and interlocking rings 24. The perforated cuts 26 permit the label to be removed at precise locations or torn into desired or predetermined lengths. It is to be appreciated that the spacing of the perforations can be customized according to the desired application. For example, a particular hospital or research institute may identify patients according to a 12 digit character string having a length of 2 inches. In such an application, the perforations 26 could be spaced at 2 inch intervals.

FIGS. 6 & 7 illustrates a die 28 which may be utilized to form the disintegratable masking label of the present invention. As shown, the die includes a pronounced diagonal X-shaped blade 30 to cut completely through the paper 12 and polystyrene liner 20. The die further includes less pronounced centrally located ring shaped blades 32 to produce the interlocking ring structure. Alternatively, the ring shaped blades 32 may be designed to create perforated rings. Additionally, the die may also include blades to create the vertical perforated cuts 26 (not shown).

Figure 2:
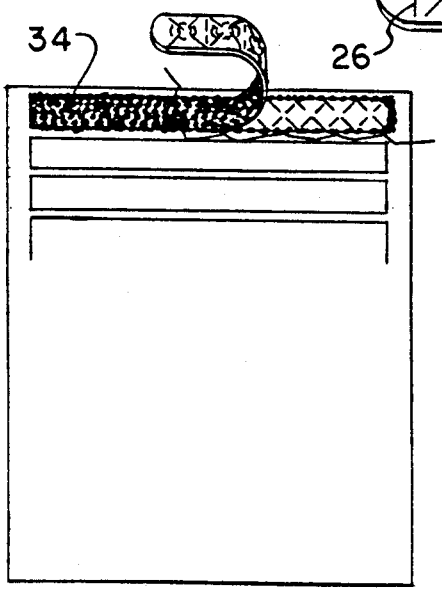
FIGS. 2 and 2A are partially broken away plan views of the disintegratable label of the present invention being peeled from its liner paper.
Figure 2A:
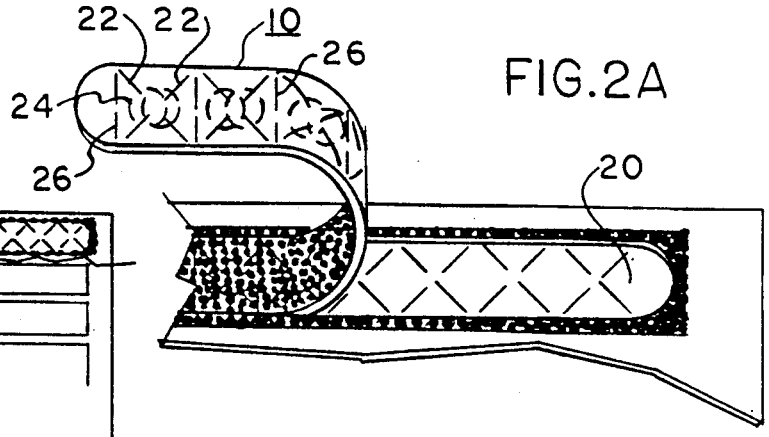

A commercial embodiment of the present invention is shown in FIGS. 1 and 2. The labels 10 form rows of horizontal strips 34 adhered to the polystyrene liner 30. It is to be appreciated that the labels may take any desired shape. As shown in FIG. 2, a strip of desired length is peeled from the polystyrene liner 20 and torn along the appropriate perforation 26. The adhesion of the label to the polystyrene backing must not be such as to cause the label to fragment and disintegrate when it is peeled from the polystyrene structure.

Figure 3:
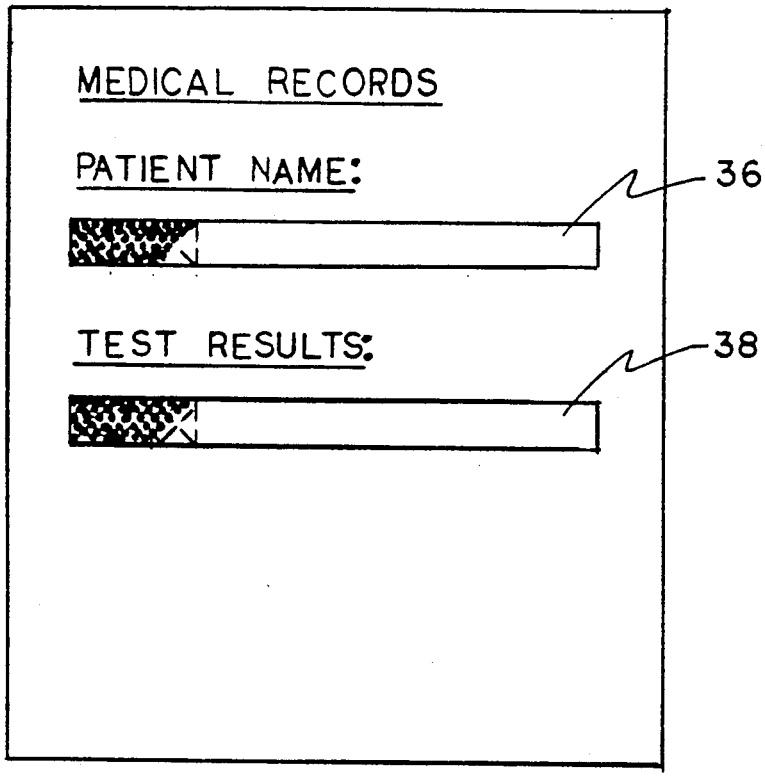
FIGS. 3 & 4 illustrate the application of the disintegratable masking label of the present invention to patient medical records both before and after tampering.
Figure 4:
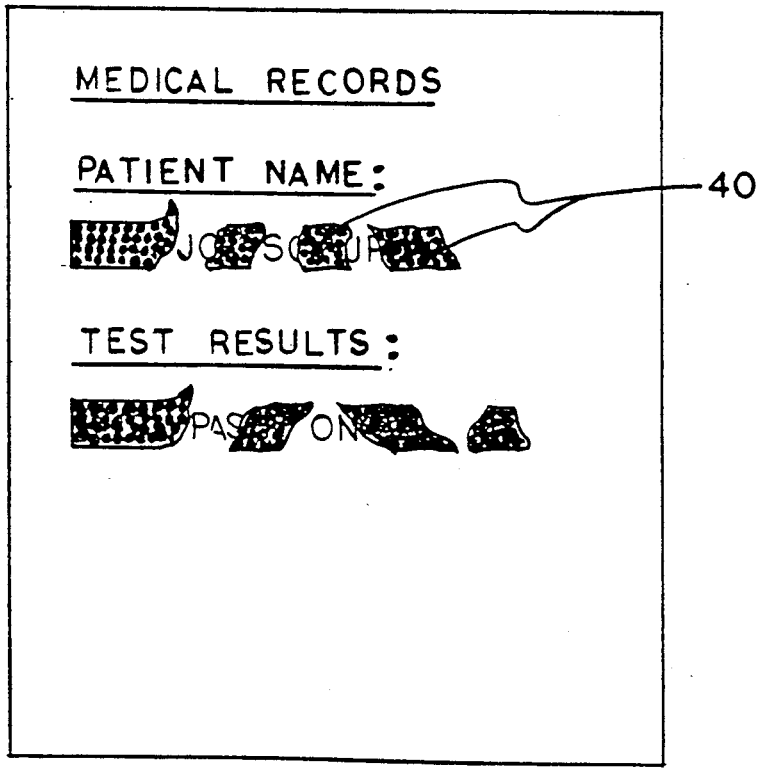

As shown in FIG. 3 and 4, the label strip portion is then placed over, for example, confidential medical records. As shown in FIG. 3, the patient's name 36 and confidential test results 38 have been blocked out by the label. For best results, upon application of the label to the test result, the paper should be turned over and the label burnished through the rear of the paper. As seen in FIG. 4, when an attempt is made to peel the label from the medical records, the label fragments and disintegrates 40 due to the existence of the diagonal tamper-proof die cuts 22 and interlocking rings 24. Broken sections of the label remain on the test form. Because the fragmented portions are so minute, the label cannot be reconstructed without providing clear evidence of tampering. The printed pattern further serves to highlight the tampering. Moreover, because the label is constructed using a removable adhesive, it will not adhere to and tear off the masked written material upon removal.

While the present invention has been described with reference to the enclosed Figures, it is to be appreciated by those skilled in the art that other embodiments fulfill the spirit and scope of the present invention, and that the true nature and scope of the present invention is to be determined with reference to the claims appended hereto. Specifically, while the present invention has been described in the context of an example involving medical records, it will be readily apparent to those skilled in the art that the present invention may be utilized in all manner of scientific research, business, academia, educational testing, law enforcement, and sports. In short, the label can be utilized in any application where it is necessary to protect the integrity and confidentiality of written matter.

In addition, while the present invention has been described as incorporating X-shaped cuts and overlapping rings, it is to be appreciated that numerous alternatively shaped cuts can be utilized in the present invention.

Finally, while the label of the present invention has been described in the context of a label strip, it is to be appreciated that the label of the present invention may assume any desired shape, height and/or width.

What is claimed:

1. A disintegrating tamper-proof label for masking the contents of written or printed matter comprising:

a label having an opaque coating and further having a removable adhesive backing for adhering said opaque paper label over written or printed matter to be masked and permitting said label to be removed without destroying said written or printed matter to be masked, said making label further having a plurality of cuts extending radially outward from the center of said label such that when said label is removed from said masked written or printed matter, said label fragments and disintegrates thereby evidencing the tampering of said label.

2. The disintegrating tamper-proof masking label of claim 1 wherein said plurality of cuts further comprise at least one ring shaped cut located proximate to the center of said label.

3. The disintegrating tamper-proof masking label of claim 1 wherein said label contains a pattern printed thereon.

4. The disintegrating tamper-proof masking label of claim 1 wherein said label further comprises a plurality of perforated sections so that said label can be torn into predetermined lengths.

5. The disintegrating tamper-proof masking label of claim 1 wherein said label is constructed from a coated litho-stock.

6. The disintegrating tamper-proof masking label of claim 1 wherein said removable adhesive backing comprises a removable rubber based adhesive.

7. A disintegrating tamper-proof masking label for masking written or printed matter comprising:

a label having an opaque coating and further having a removable adhesive backing for adhering said label and opaque coating to written or printed matter to be masked;

a silicone coated liner for holding said label, said label being peeled from said liner so as to be applied to said written or printed matter to be masked, said label further having a plurality of cuts extending radially outward from the center of said label such that when said label is removed from said masked written or printed matter to be masked, said label fragments and disintegrates so as to evidence the tampering of said label, while not destroying said masked written or printed matter.

8. The disintegrating tamper-proof masking label of claim 7 wherein said cuts further comprise at least two interlocking ring shaped cuts located proximate to the center of said label.

9. A disintegrating tamper-proof label for masking the contents of written or printed matter comprising;

a label having an opaque coating and further having a removable adhesive backing for adhering said opaque paper label over written or printed matter to be masked and permitting said label to be removed without destroying said written or printed matter to be masked, said masking label further having a plurality of ring-shaped interlocking cuts such that when said label is removed from said masked written or printed matter, said label fragments and disintegrates thereby evidencing the tampering of said label.

* * * * *

UNITED STATES PATENT AND TRADEMARK OFFICE

CERTIFICATE OF CORRECTION

PATENT NO. : 5,013,088

DATED : May 7, 1991

INVENTOR(S) : Thomas C. Marin

It is certified that error appears in the above-identified patent and that said Letters Patent is hereby corrected as shown below:

Title page, in the Abstract, line 4, change "silicon" to --silicone--.

Column 4, claim 1, line 39, change "making" to --masking--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*